US005987850A

United States Patent [19]

Schoch et al.

[11] Patent Number: 5,987,850

[45] Date of Patent: Nov. 23, 1999

[54] PROCESS FOR THE APPLICATION OF A REVENUE SEAL TO A CIGARETTE PACK

[75] Inventors: Reinhard A. Schoch; H.H. Detlef Friedrich, both of Hamburg, Germany

[73] Assignee: H.F. & Ph. F. Reemtsma GmbH, Hamburg, Germany

[21] Appl. No.: 09/032,444

[22] Filed: Feb. 27, 1998

[30] Foreign Application Priority Data

Mar. 6, 1997 [DE] Germany ..... 197 11 108

[51] Int. Cl.[6] ..... B65B 61/26

[52] U.S. Cl. ..... 53/415; 53/135.1; 53/136.1

[58] Field of Search ..... 53/415, 135.1, 53/136.1, 397, 383.1

[56] References Cited

U.S. PATENT DOCUMENTS

| | | | |
|---|---|---|---|
| 3,772,848 | 11/1973 | Rudszinat et al. | 53/24 |
| 4,330,976 | 5/1982 | Blackall et al. | 53/151 |
| 4,969,305 | 11/1990 | York et al. | 53/137 |
| 5,131,967 | 7/1992 | Tweadey et al. | 156/101 |
| 5,375,613 | 12/1994 | Aindow et al. | 131/281 |

FOREIGN PATENT DOCUMENTS

| | | |
|---|---|---|
| 0540184A1 | 5/1993 | European Pat. Off. . |
| 4113714A1 | 10/1992 | Germany . |
| 4218471A1 | 12/1992 | Germany . |
| 4332853A1 | 3/1995 | Germany . |

OTHER PUBLICATIONS

Rompp Chemie Lexikon—pp. 2456–2457.

Verfahrensfortschritte zur Oberflachenvorbehandlung Papier + Kunstsoff–Verarbeiter 3–88.

*Primary Examiner*—Joseph J. Hail, III
*Assistant Examiner*—William Hong
*Attorney, Agent, or Firm*—Foley & Lardner

[57] ABSTRACT

A cigarette pack is treated with a larger beam in the areas (6) onto which the revenue seal (7) is to be glued, in such a way that the coating of the pack is destroyed there.

5 Claims, 1 Drawing Sheet

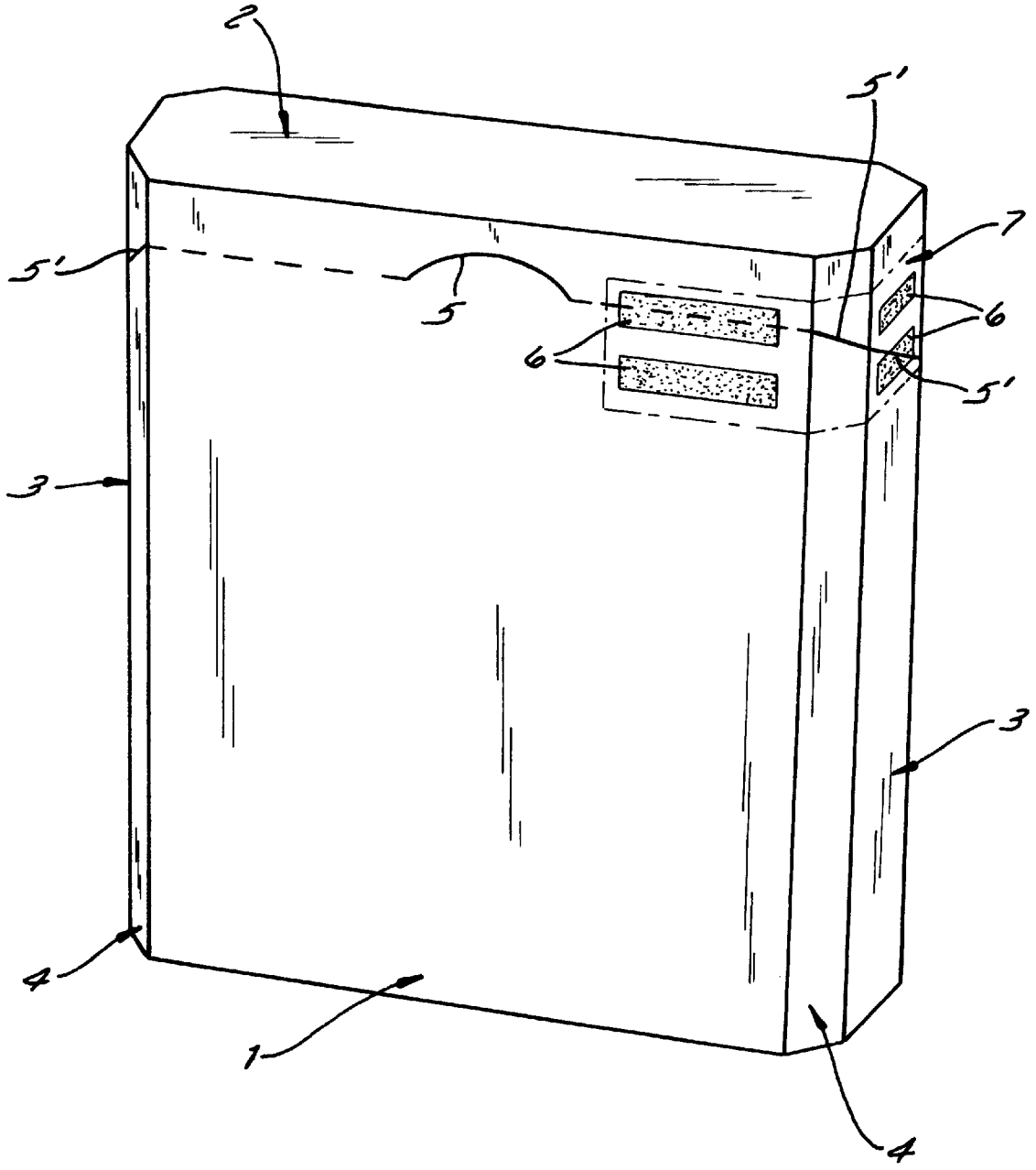
2
5'
7
5'
5
6
6
5'
3
3
4
1
4

PROCESS FOR THE APPLICATION OF A REVENUE SEAL TO A CIGARETTE PACK

The invention relates to a process for the application of a revenue seal to a cigarette pack.

From the magazine article by Hartmann, Rolf: "Progress in the process of preliminary surface treatment", in German magazine "Papier+Kunststoff-Verarbeiter" 3/1988, pages 9–11, 14, it is known that packaging materials frequently require a preliminary treatment in order to ensure a better adhesion of the glue or adhesive. For that purpose, for example a treatment by means of corona-discharge or a plasma-treatment is used.

Furthermore, the use of lasers in packaging is also known. With these, amongst other things, individual layers of labels are burned out for the purpose of inscription (DE 43 32 853 A1), cigarettes are perforated to produce an area which is permeable to air (DE 42 18 471 A1) or weakening lines in packaging material are produced, which consist either of a linear continuous material weakening (DE 41 13 714 A1) or of a line of material completely cut in two section wise (EP 05 40 184 A1).

In Germany and also in many other countries, a revenue seal must be glued onto all cigarette packaging and it must be done in such a way that the revenue seal is destroyed when the pack is opened. As a rule, the revenue seal is stuck onto the packet with ordinary glue in such a manner that it has to be destroyed on opening.

In the case of uncoated packaging with distinct side edges, this causes few problems; however, in the case of packaging with chamfered edges, which additionally, is optionally provided with a smooth coating, the revenue seal easily becomes detached from the packaging or it remains suspended from the lower or upper part of the packet when the pack is opened.

It is, therefore, the object of the invention to improve the adhesion of the revenue seal to cigarette packs which are provided with a smooth coating or which, because of the particular shape of the pack, have a smaller surface for glueing than is the case with conventional cigarette packs.

A process of the initially-mentioned type serves as a means of achieving said object, by which process the coating is destroyed by irradiation with a laser in the glueing area of the revenue seal.

Thereby, a better surface for glueing is created, to which the revenue seal immediately adheres, in such a manner that the seal is broken (destroyed) when the pack is torn open.

The invention is explained in more detail below with reference to a drawing:

The single figure shows an octagonal cigarette pack with a back 1, a top 2, with sides 3 and with chamfered edges 4, in which the top 2 is connected to the back 1 along a fold line 5. In the region of the chamfered edges 4, the sides 3 and the front which cannot be seen in the drawing, the fold line 5 turns into a opening edge or dividing line 5', which breaks the sides 3, the front and the chamfered edges 4 and in doing so allows the top 2 to be lifted up so as to open the pack in order to take out cigarettes.

For certain cigarettes, in particular for so-called luxury brands, the walls of the pack have a particular coating which, as a rule, is so smooth that a revenue seal 7, represented in the drawing only indicatively, adheres poorly to it. In order to overcome this difficulty, according to the invention, in areas 6 where the revenue seal is to be glued, the coating is destroyed, either mechanically or with a laser so that the surface of the pack in the areas 6 is not as smooth as the rest of the coating. The destruction takes place by laser during production of the pack using equipment known per se which is readily available to the person skilled in the art.

It is clear from the attached drawing that one or more areas 6 have been expediently treated with a laser beam on the back 1 of the pack, these areas 6 covering the fold line 5 and thus, ensuring that a revenue seal stuck on in the destroyed areas 6 is damaged, It is also clear from the drawing that the areas 6 which are treated by laser are not only positioned on the backs of the pack, but also on one side 3, so that the smooth coating of the pack is also destroyed there. The exposed, destroyed areas 6 on the side 3 represent a continuation of the destroyed areas 6 on the back, in that a revenue seal 7 which is glued onto the back over the destroyed areas 6 and is folded over the chamfered edge 4 onto the side 3, covers the destroyed areas present there 6 and adheres well to them.

In this way, it is guaranteed that, when the top 2 is raised, the revenue seal 7 in the region of the dividing line 5' is torn.

In another version of the invention, the specially treated areas 6 are provided only on one side 3 or only on the back 1 of the pack.

What is claimed is:

1. A method for affixing a revenue seal to a cigarette pack having a smooth coating comprising the steps of:

destroying the coating in a plurality of discrete areas where the revenue seal is to be attached by directing a laser beam upon such areas;

applying an adhesive to at least the discrete areas on which the smooth coating has been destroyed; and applying a revenue seal over the discrete areas to affix same to the cigarette pack.

2. A method for affixing a revenue seal to a cigarette pack having a plurality of sides and wherein the revenue seal is to be attached to at least two sides of the pack, the cigarette pack having a smooth coating over the exterior surface thereof, the method comprising the steps of:

destroying an area of the smooth coating on at least two sides of the pack where the revenue seal is to be affixed by directing a laser beam on said sides;

applying an adhesive to at least one of the area on which the coating is destroyed or the seal; and applying the seal to the pack, whereby the adhesive bonds the seal to the pack.

3. The method of claim 2 wherein the step of destroying the smooth coating is carried out on at least two discrete areas, at least one such discrete area being present on each side of the pack.

4. A method for affixing a revenue seal to a cigarette pack provided with a smooth coating, the cigarette pack having a plurality of adjoining sides and chamfered edges between each pair of adjoining sides, the process comprising the steps of:

destroying the smooth coating on the cigarette pack by directing a laser beam thereon in the area in which the revenue seal is to be applied, such coating destruction being carried out on at least two sides of the pack;

applying an adhesive to at least one of the area in which the coating is destroyed or the revenue seal; and applying the revenue seal to the cigarette pack whereby the revenue seal is adhered to the pack over area in which the coating has been destroyed.

5. The method of claim 4 wherein the coating is destroyed on at least one discrete area on each of two adjoining sides of the cigarette pack, a chamfered edge being provided between the two sides.

* * * * *